United States Patent [19]

Kaufmann et al.

[11] 4,254,802

[45] Mar. 10, 1981

[54] APPARATUS FOR REINFORCING A HEDDLE FRAME SLAT OF A LOOM

[75] Inventors: Frank H. Kaufmann; Charles F. Kramer, both of Greenville, S.C.

[73] Assignee: Steel Heddle Manufacturing Co., Greenville, S.C.

[21] Appl. No.: 39,952

[22] Filed: May 17, 1979

[51] Int. Cl.[3] ..... D03C 9/06

[52] U.S. Cl. ..... 139/91

[58] Field of Search ..... 139/91, 92; 285/66

[56] References Cited

U.S. PATENT DOCUMENTS

| | | | |
|---|---|---|---|
| 3,155,118 | 11/1964 | Kaufmann | 139/91 |
| 3,889,721 | 6/1975 | Wagner | 139/91 |

*Primary Examiner*—Henry Jaudon

*Attorney, Agent, or Firm*—Bailey, Dority & Flint

[57] ABSTRACT

Apparatus for reinforcing a heddle frame slat of a weaving loom is disclosed wherein reinforcing side plates are provided on opposing sides of frame slats of the heddle frame in an area wherein a drive connector is connected with the frame slats which support and reciprocate the heddle frame during shedding and wherein slats and a portion of the plate means are made to contact and provide a reinforced wear surface for the drive connector as well as make rigid integral connection with a latch carried within the interior of the frame slats which engages with the drive connector.

3 Claims, 7 Drawing Figures

APPARATUS FOR REINFORCING A HEDDLE FRAME SLAT OF A LOOM

BACKGROUND OF THE INVENTION

Heretofore, different materials have been utilized in the construction of heddle frames for weaving looms, and in an attempt to make the heddle frames more lightweight and lessen the power required to drive the heddle frame in vertical motions during shedding, lightweight extruded aluminum frame rails or slats have been proposed. However, it has been found that the lightweight aluminum material is susceptible to excessive wear and weakening in certain critical areas. In particular, a critical area exists where the heddle frame slats are typically slotted to provide a hollow portion in which a drive connector hook is received for engaging a latch therein whereby the frame slat is supported and reciprocated during shedding. Within this hollow portion, a great deal of wear occurs and, due to the softness of the aluminum metal, the wear produces increased play which leads to further wear and eventually fatigue failure.

Attempts have been made with various other types of heddle frames to reinforce and strengthen the heddle frame in critical areas of the frame slat such as where driving connection is made. One such attempt is shown in United States patent 3,889,721 which discloses a heddle beam or slat constructed from multiple parts such that the confronting ends of adjacent parts are provided with hollow facing and an insert part, carrying a drive connector, is inserted in each of the hollow facings rigidly connecting them together. However, the construction of beams in multiple parts it itself creates additional bending problems and unpredicted weakening.

SUMMARY OF THE INVENTION

The invention relates to reinforcement of a heddle frame slat of the type which includes a lightweight tubular construction defined by spaced sidewalls and spaced edges integrally joining the sidewalls, a latch carried within a hollow slot portion, and an elongated slot opening formed in one of the edges through which a drive connector is inserted into the hollow slot for engaging the latch whereby the heddle frame is supported and reciprocated during shedding.

It has been found that reinforcement of an extruded metal frame slat can be provided by forming a notched out area in the frame slat sidewalls which includes an area devoid of material in the area wherein the slat is slotted out for insertion of a drive connector, and a pair of elongated reinforcing plates carried on the sidewalls of the frame slats overlying the notched area enabling integral connection between the plate means and a drive connector latch carried within the hollow slot portion affording a reinforced and stronger connection therebetween. Further, the notch means may include a second area wherein the metal is cutout from the sidewalls and an indention may be formed in the plate means which is received within the second notched area and exposed to the hollow slot interior so that a reinforced wear surface is provided for contacting the drive connector inserted therein.

Accordingly, an important object of the present invention is to provide a reinforced, lightweight extruded metal frame slat for a heddle frame.

Yet another important object of the present invention is to provide a reinforced frame slat for a heddle frame which strengthens the frame slat and reduces wear in the area where driving connection is made to the frame slat.

Still another important object of the present invention is the provision of a reinforced frame slat wherein reinforcing plate means are provided on the outside of the frame slat which are made to have exposure and connection to an interior portion of the frame slat facilitating integral connection and reduced wear therein.

BRIEF DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

DESCRIPTION OF A PREFERRED EMBODIMENT

Figure 1:
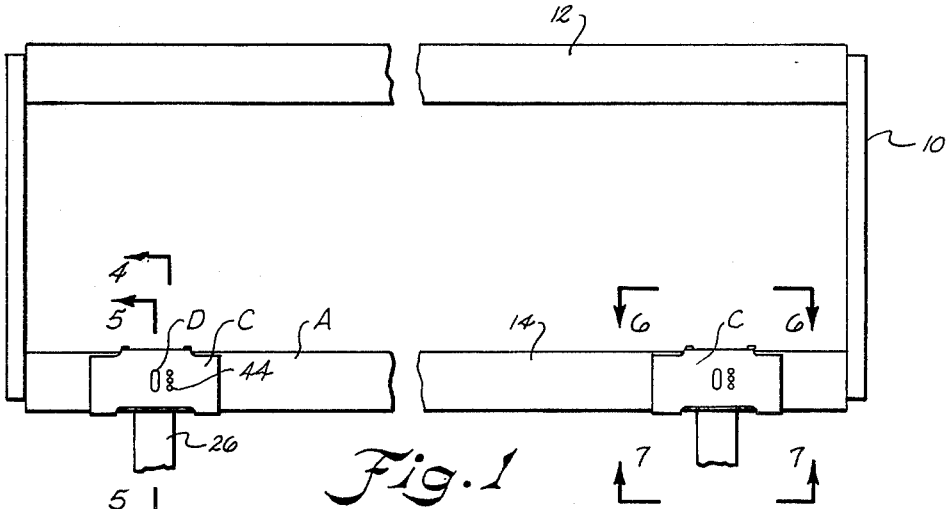
FIG. 1 is a front elevation illustrating a heddle frame having reinforced frame slats according to the invention.

The invention relates to apparatus for reinforcing a frame slat on a heddle frame of a weaving loom. Since the remaining parts of a weaving loom are conventional and are not related to the present invention, only that portion of the weaving loom, namely the heddle frame, is illustrated as is necessary for an understanding of the invention.

Referring now to the drawings, a reinforced extruded aluminum frame slat A for a heddle frame of a weaving loom is disclosed which is of the type that typically includes a tubular construction having a hollow slot portion defined by spaced opposing sidewalls and spaced edges integrally joining said sidewalls with one of the edges having an elongated slot opening therein providing access to the hollow slot portion whereby a drive connector may be inserted therein for engaging and cooperating with a latch means carried in the hollow slot to support and reciprocate the heddle frames during shedding. The reinforced frame slat comprises a notch means B formed in the frame slat sidewall which includes an area thereof devoid of the aluminum material and elongated reinforcing plate means C carried on the opposing sidewalls of the frame slats in the area of the slot opening leading to the hollow portion and overlying the notch means B.

The notch means B includes an area cut out from the sidewalls so as to be devoid of aluminum material enabling contact between the plate means C and the latch means carried with the hollow slot to facilitate integral connection therebetween. Coextending indentation means D are formed in the plate means which are received within a second area of the notch means B in which aluminum material is removed to thereby expose the indented portion of the reinforcing plate means to the interior of the hollow slot of the frame slat for contact with the drive connector means when inserted therein affording a reinforced wear surface therefor.

Figure 2:
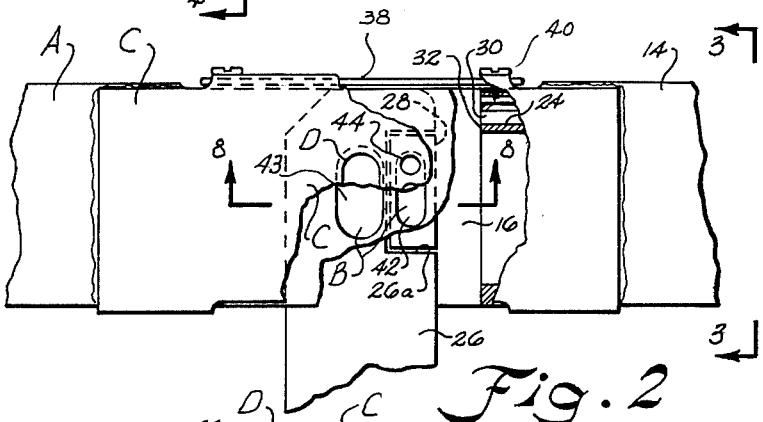
FIG. 2 is an enlarged front elevational view of the reinforced section of the heddle frame slat with parts thereof cut away illustrating the method and reinforcing structure of the present invention.
Figure 3:
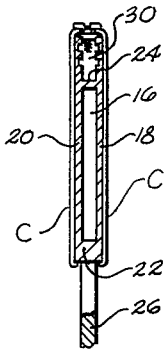
FIG. 3 is a sectional view taken along line 3—3 of FIG. 2.
Figure 8:
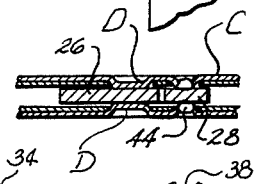
FIG. 8 is a sectional view taken along line 8—8 of FIG. 2.
Figure 4:
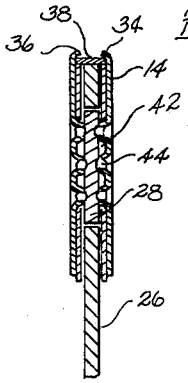
FIG. 4 is a sectional view taken along line 4—4 of FIG. 1.
Figure 5:
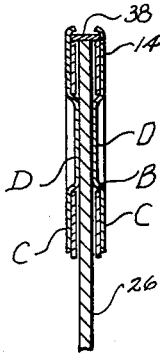
FIG. 5 is a sectional view taken along line 5—5 of FIG. 1.
Figure 6:
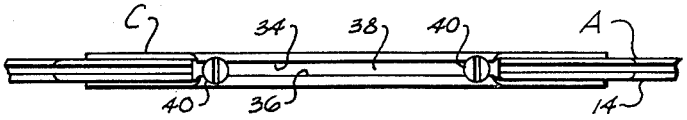
FIG. 6 is a plan view as viewed along line 6—6 of FIG. 1.
Figure 7:
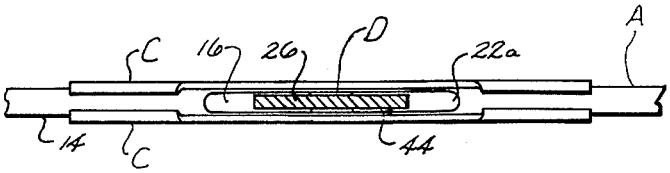
FIG. 7 is a plan view taken along line 7—7 of FIG. 1.

Referring now in more detail to FIGS. 1 and 2, a heddle frame 10 is illustrated as including an upper and lower frame slat 12 and 14. While the invention may have application to reinforcing various types of heddle frame slat structures, the invention has been found to be particularly advantageous for reinforcing heddle frame slats of the extruded aluminum type which typically include a tubular construction such as illustrated. The tubular construction includes a hollow slot portion 16 defined by spaced opposing sidewalls 18 and 20 of the frame slats and spaced edge means 22 and 24 integrally joining the sidewalls. One of the edge means 22 has an elongated slot opening **22*a* formed therein whereby a drive connection means typically in the form of a push rod hook 26 having a C-shaped hook portion 26*a*, may be inserted. When inserted for supporting and reciprocating the heddle frame during shedding, the drive connector means 26 is engaged with a latch means 28** which is illustrated in the form of a correspondingly shaped metal block which is reinforced in its construction and connection within the hollow slot portion of the frame slat as will be more fully explained hereinafter.

The illustrated frame slat A further includes a dovetail groove 30 formed in the edge means 24 which accommodates the placement of rod hooks to which a heddle rod is fastened which support the heddles in a conventional manner. To accommodate the insertion and placement of the push rod drive hook 26, it is often necessary to groove out the bottom of the dove-tail groove 30 such as at 32.

Turning now in more detail to the reinforcing structure of the present invention, the reinforcing plate means C are illustrated as including inwardly extending flange means 34 and 36 which extend toward one another and partially overlie the portion of the edge 24 which is cut out at 32 for accommodating the hook connector 26. Beneath the flange means 34 and 36, an enclosure plate 38 is received which serves to limit any outward movement and aid in retaining the hook connector 26 in the hollow slot portion. The plate 38 may be secured by screws 40.

The plate means C may be any suitable wear resistant reinforcing metal such as stainless steel. The first cut out area 42 of notch means B affords direct contact between the reinforcing plate means C and the latch block 28 for integral connection such as by spot welding at 44. Such provides a stronger, more rigid connection and construction of the latch block 28 which is subject to sudden opposite vertical forces during the jerking of the heddle frame up and down during shedding by means of the hook connector 26. The indentation means D may be formed therein as an oval indented slot to conform to the shape of the second notch cut out area 43 of B by any conventional means such as stamping. The indentation D of the reinforcing plate C presents a hardened steel wear surface to the drive connector hook 26 inserted within the hollow slot 16 so that the hook connector wears against the steel instead of the soft aluminum. Thus, considerable wear and free play is eliminated within the hollow slotted drive connection portion of the frame slat which is already weakened by slotting out and is highly susceptible to fatigue failure.

The reinforcing plate means C may be attached to the aluminum sidewalls of the frame slat in any suitable manner such as by utilizing a high strength adhesive. The elongated plate means provides further strengthening by affording resistance to bending forces in this critical area of the frame slat.

Thus, it can be seen that a highly advantageous plate and frame slat structure for reinforcing the drive connection area of a heddle frame slat is provided according to the invention wherein the sensitive and critical fatigue areas of an extruded aluminum frame slat are reinforced against bending and the slotted interior is reinforced against wear.

While a preferred embodiment of the invention has been described using specific terms, such description is for illustrative purposes only, and it is to be understood that changes and variations may be made without departing from the spirit or scope of the following claims.

What is claimed is:

1. A reinforced frame slat for a heddle frame of a weaving loom, wherein the heddle frame slat is of the type which includes a lightweight tubular construction having a hollow slot portion defined by spaced sidewalls, latch means carried within said hollow portion, and one of said edges having an elongated slot opening therein whereby drive connector means may be inserted therein to engage said latch means for supporting and reciprocating the heddle frame during shedding, said reinforced frame slat comprising:

notch means formed in said frame slat sidewalls defined by an area of said sidewall being cut out and removed therefrom;

elongated reinforcing plate means carried on the sidewalls of said frame slats in the area of said slot opening overlying said notch means; and said notch means being formed in an area of said sidewalls generally overlying said latch means enabling contact between said plate means and said latch means to facilitate integral connection therebetween reinforcing said frame slat during reciprocation.

2. The structure of claim 1 wherein said notch means includes a second area of said frame slat sidewalls devoid of material and including indentation means formed in said plate means received within said second area of said notch means and exposed to the interior of said hollow slot portion for contact with said drive connector means when engaged in said hollow slot portion affording a reinforced wear surface therebetween.

3. The structure of claim 1 wherein said frame slat includes an open top groove in the other of said edges, said elongated plate means including inwardly extending flange means partially overlying said open top groove for receiving and accommodating enclosure means serving to locate said drive connector means in said hollow slot portion.

* * * * *